US006128826A

United States Patent [19]

Robinson

[11] Patent Number: 6,128,826

[45] **Date of Patent: *Oct. 10, 2000**

[54] COMBINATION DRYING UNIT

[76] Inventor: Joe M. Robinson, 1334 Timberlane Rd., Tallahassee, Fla. 32312

[ * ] Notice: This patent is subject to a terminal disclaimer.

[21] Appl. No.: 09/245,368

[22] Filed: Feb. 5, 1999

[51] Int. Cl.[7] ..... F26B 19/00

[52] U.S. Cl. ..... 34/90

[58] Field of Search ..... 34/90, 91, 427; 392/380

[56] References Cited

U.S. PATENT DOCUMENTS

| | | | |
|---|---|---|---|
| 2,229,559 | 1/1941 | Fox | 34/19 |
| 2,634,514 | 4/1953 | Clemens | 34/243 |
| 2,676,418 | 4/1954 | Shewmon | 34/77 |
| 3,878,621 | 4/1975 | Duerre | 34/90 |
| 4,336,619 | 6/1982 | Hinkel et al. | 4/619 |
| 4,383,377 | 5/1983 | Crafton | 34/60 |
| 4,785,162 | 11/1988 | Kuo | 219/368 |
| 5,186,360 | 2/1993 | Mease et al. | 222/63 |
| 5,442,867 | 8/1995 | Robinson | 34/90 |
| 5,604,992 | 2/1997 | Robinson | 34/90 |
| 5,727,579 | 3/1998 | Chardack | 134/95.2 |
| 5,806,203 | 9/1998 | Robinson | 34/90 |
| 5,873,178 | 2/1999 | Johnson | 34/20 |
| 5,992,039 | 11/1999 | Bunch et al. | 34/91 |

*Primary Examiner*—Stephen Gravini
*Assistant Examiner*—Andrea M. Joyce
*Attorney, Agent, or Firm*—Peter Loffler

[57] ABSTRACT

A combination drying unit has a towel roll rotatably held within a housing. By activation of a switch, a motor drives a drive roller that has an idler roller biased thereagainst for advancing the paper towel stream through a first opening of the housing. A blower is also disposed within the housing and blows a stream of air through at least one second opening on the housing. A sensor activates the motor and the blower. A sensor detects the presence of a towel stream and deactivates the motor until this sensor no longer detects the paper towel stream. Another sensor detects the absence of a towel stream, deactivates the motor, and increases the length of operation of the blower upon activation of the switch. This sensor also illuminates a service light indicating either a jam condition or an out of paper condition.

12 Claims, 8 Drawing Sheets

10
12
84

10
14
84
74
22
70
70
20
16

COMBINATION DRYING UNIT

BACKGROUND OF THE INVENTION

1. Field of the Invention

The present invention relates to a drying unit capable of dispensing a stream of air, as well as a towel stream.

2. Background of the Prior Art

The utility of providing a combination air stream dispenser and a towel stream dispenser in one cooperative device is well known, the benefits of which have been explored in my U.S. Pat. Nos. 5,442,867, 5,604,992 and 5,806,203 and will not be discussed further here. However, I have discovered further utility in providing a combination drying unit that minimizes parts and simplifies construction and maintenance and increases operating efficiency. Specifically, a drying unit that has enhanced control capabilities, as well as adverse operating condition routines, is called for in the art.

SUMMARY OF THE INVENTION

The combination drying unit of the present invention adds to the teachings of my prior patents identified above. A combination drying unit has a towel roll rotatably held within a housing between a pair of rods. A motor drives a drive roller that has an idler roller biased thereagainst for advancing the paper towel stream through a first opening of the housing. At least one leaf spring biases the idler roller toward the drive roller. A blower, having an optional heating element, is also disposed within the housing and blows a stream of air through at least one second opening on the housing. A switch, which may be a sensor, activates the motor and the blower. A first sensor detects the presence of a towel stream and deactivates the motor until the first sensor no longer detects the paper towel stream. A second sensor detects the absence of a towel stream, deactivates the motor and increases the length of operation of the blower upon activation of the switch. The second sensor also illuminates a service light indicating the possibility of a paper jam or that the roller is empty.

BRIEF DESCRIPTION OF THE DRAWINGS

Similar reference numerals refer to similar parts throughout the several views of the drawings.

DESCRIPTION OF THE PREFERRED EMBODIMENT

Figure 1:
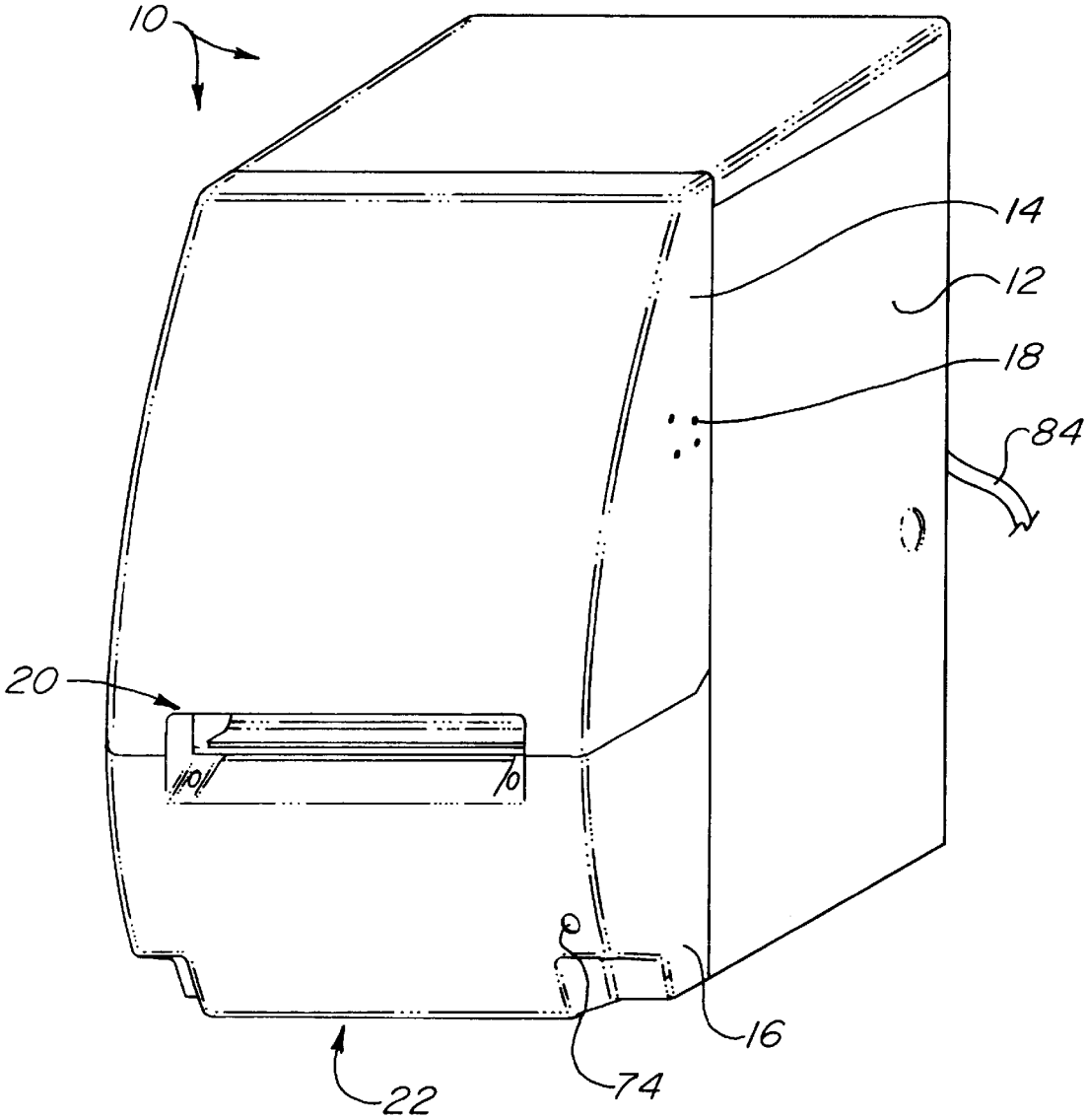
FIG. 1 is a perspective view of the combination drying unit of the present invention.
Figures 2, 3:
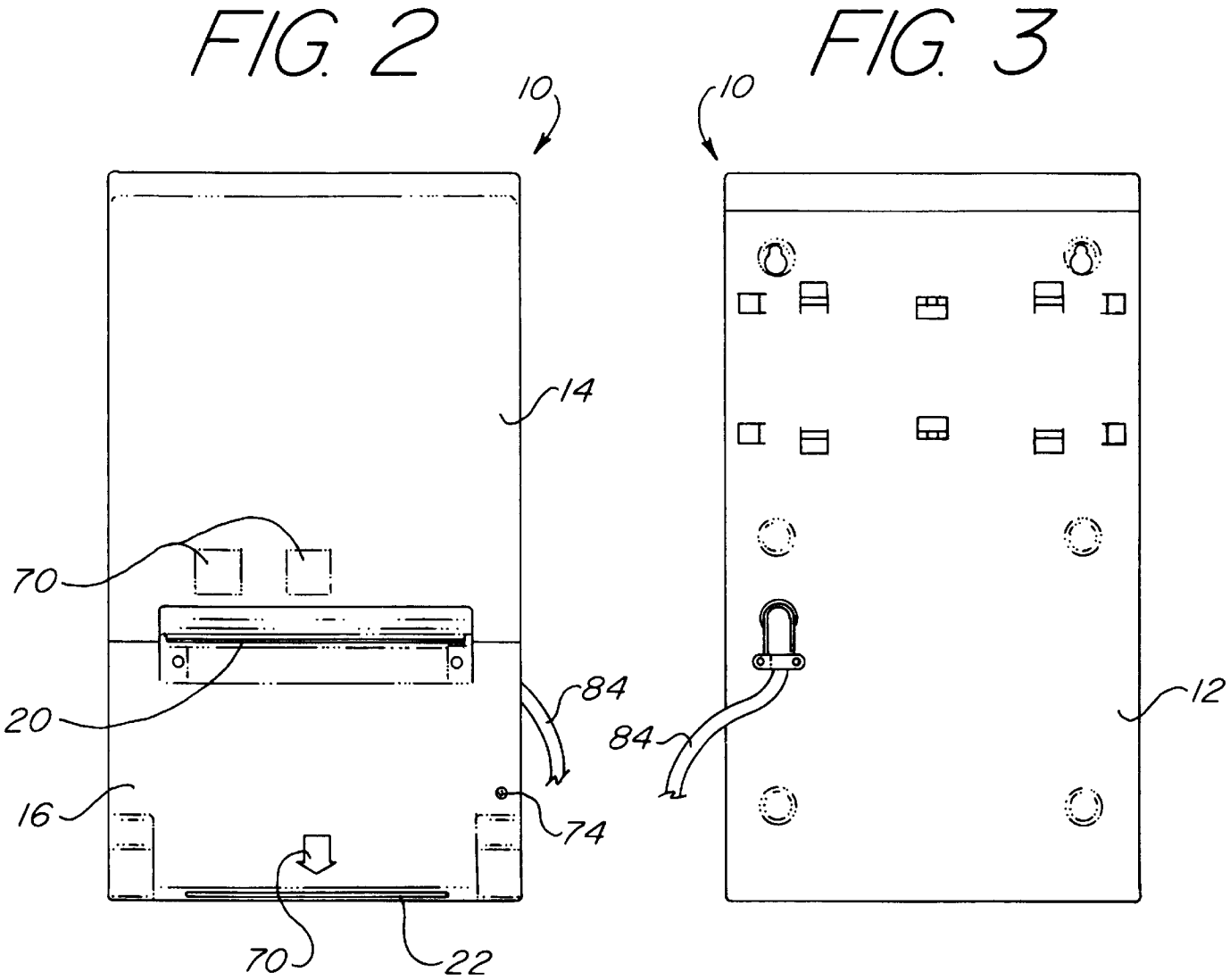
FIG. 2 is a front elevation view of the combination drying unit.
FIG. 3 is a rear elevation view of the combination drying unit.
Figure 5:
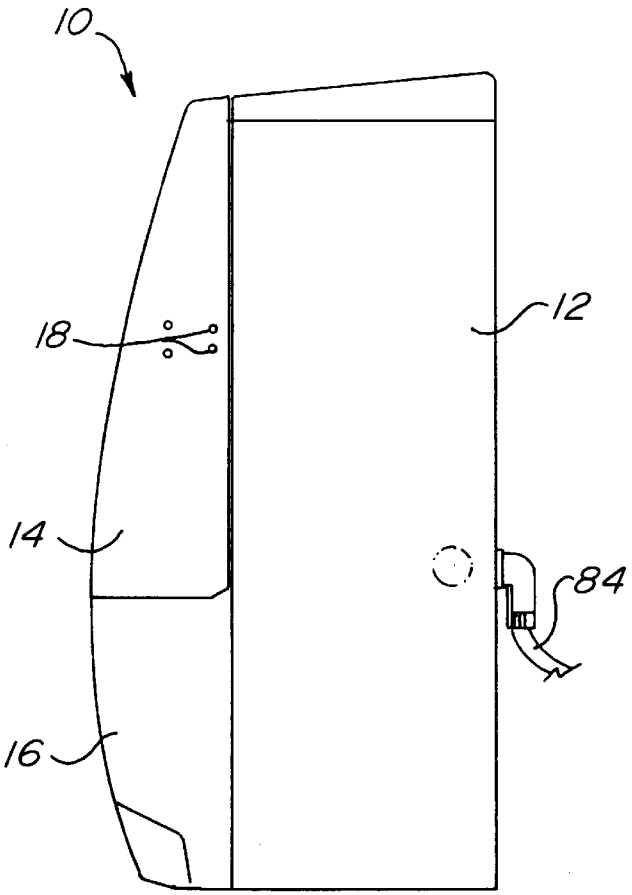
FIG. 5 is a right side elevation view of the combination drying unit.
Figure 4:
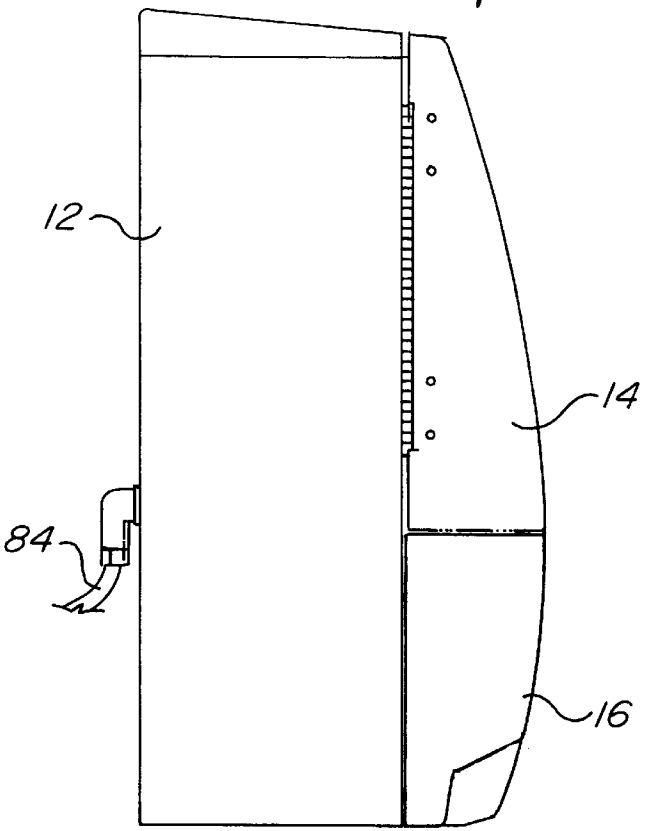
FIG. 4 is a left side elevation view of the combination drying unit.
Figure 6:
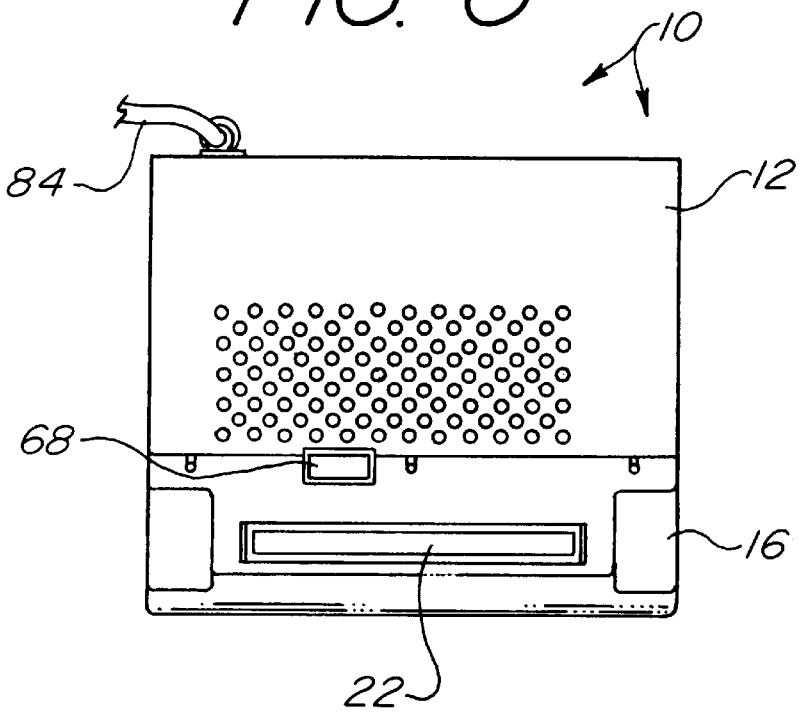
FIG. 6 is a bottom elevation view of the combination drying unit.
Figure 7:
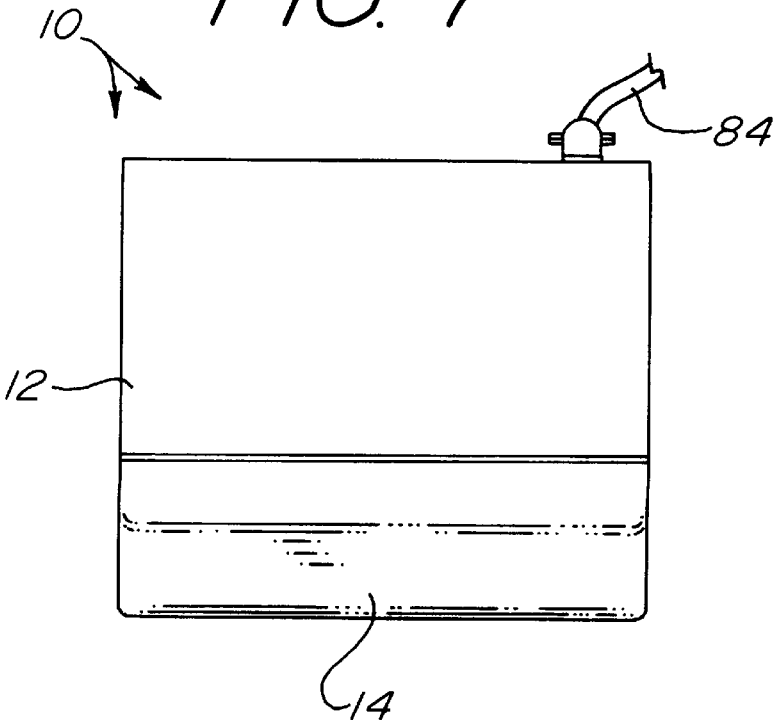
FIG. 7 is a top plan view of the combination drying unit.
Figure 8:
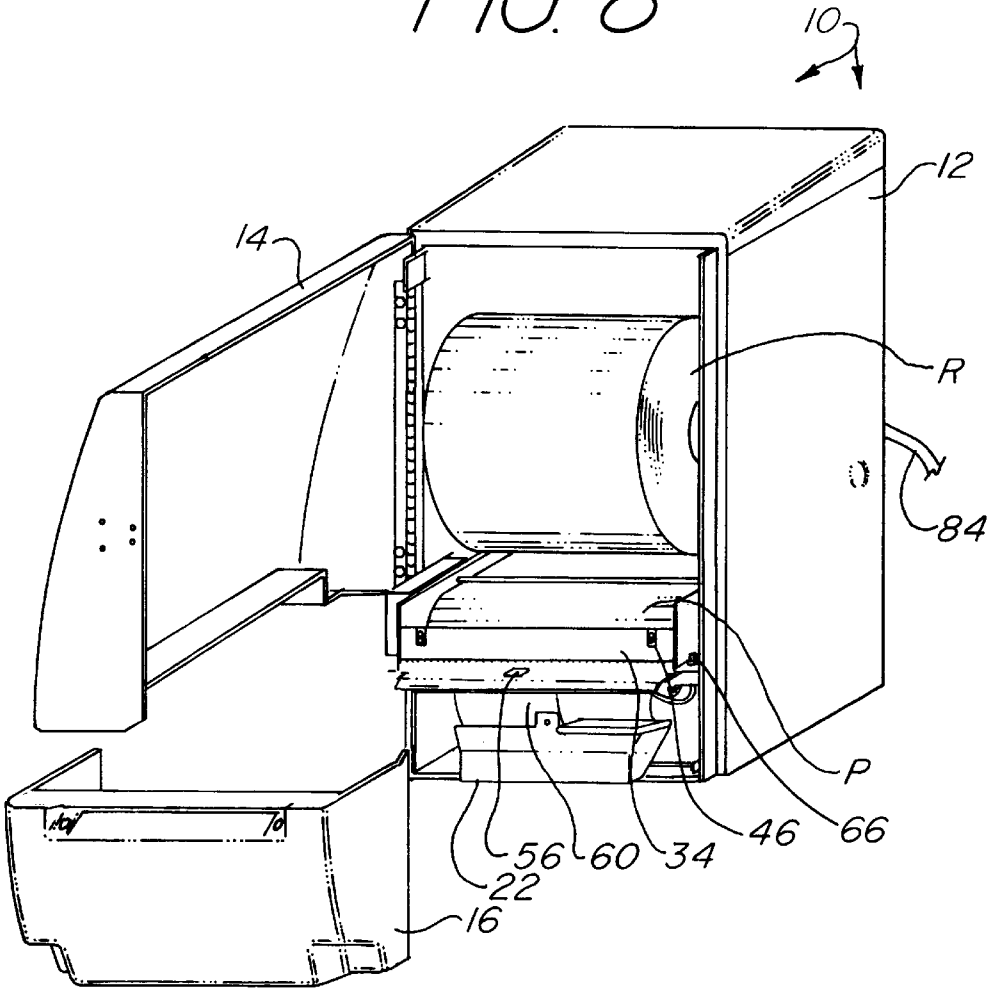
FIG. 8 is a perspective view of the combination drying unit with the covers opened.
Figure 9:
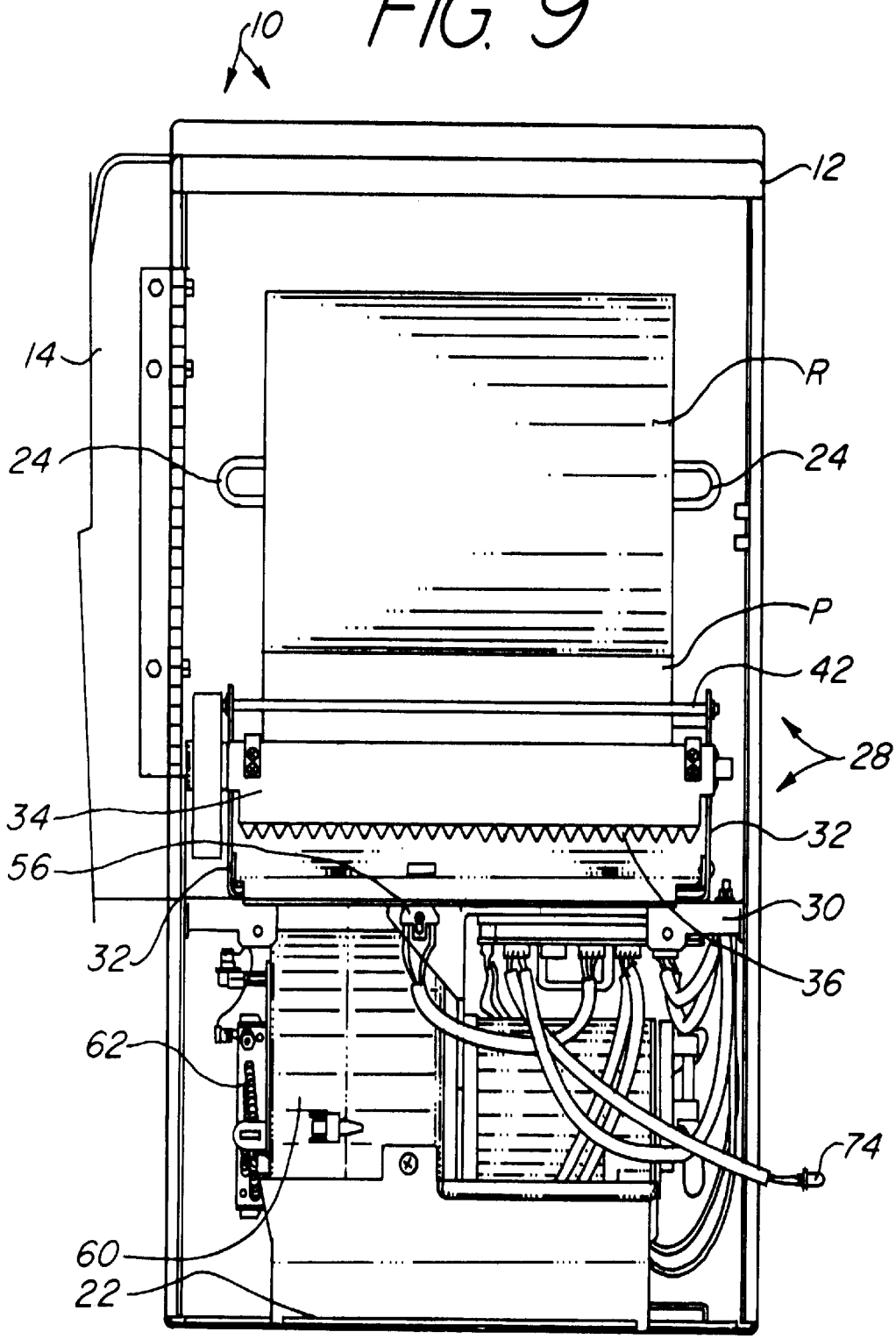
FIG. 9 is a front elevation view of the combination drying unit with the covers opened.
Figure 10:
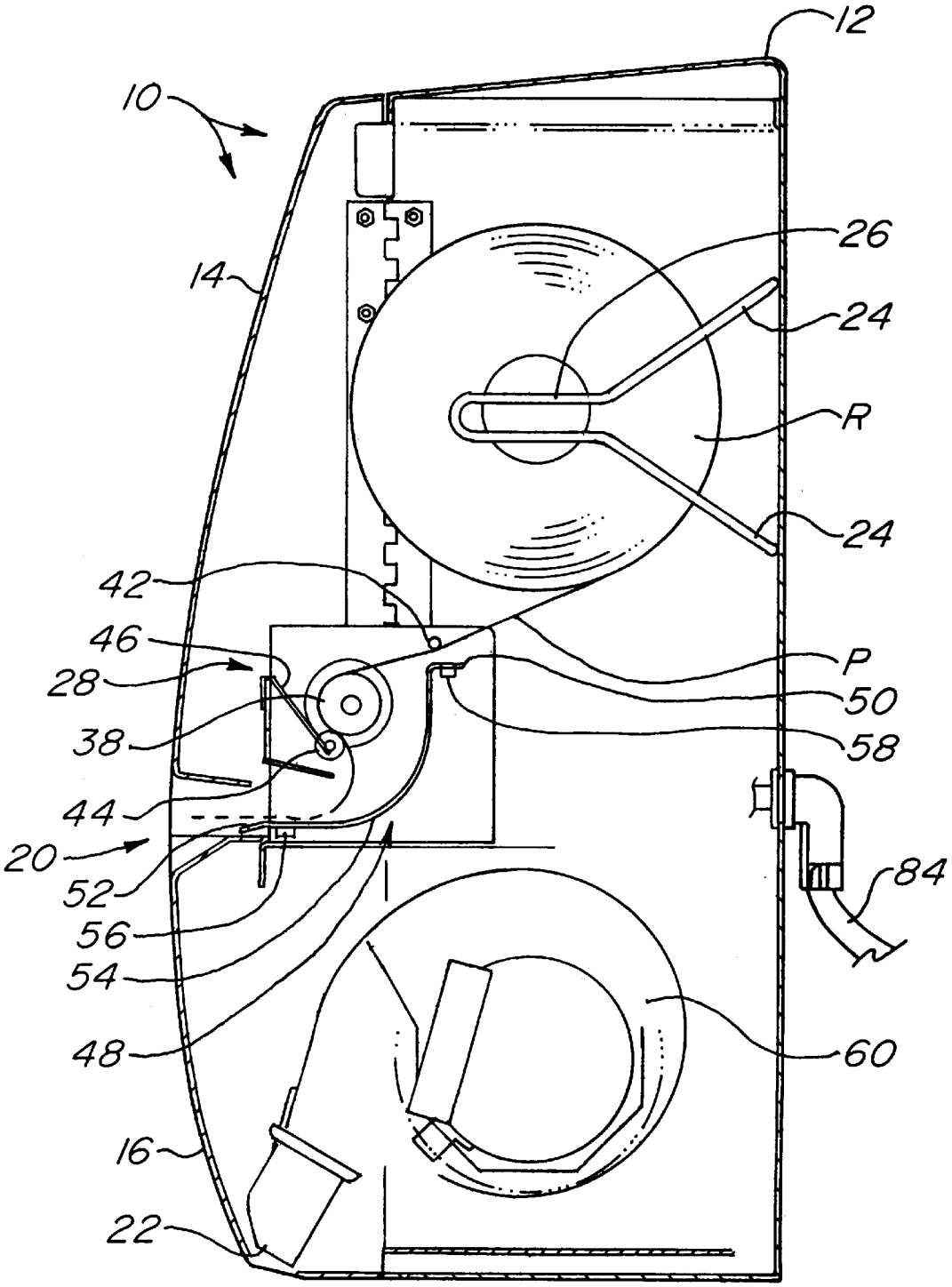
FIG. 10 is a right side sectioned view of the combination drying unit.

Referring now to the drawings, it is seen that the combination drying unit of the present invention, generally denoted by reference numeral 10, is comprised of a housing 12 having an upper front cover 14 hingedly (shown) or removably attached thereto, while a lower front cover 16, is removably (shown) or hingedly attached to the housing 12. A lock 18 of any appropriate design locks the upper front cover 14 to the housing 12, such that the upper front cover 14 must be opened before the lower front cover 16 can be opened.

The housing 12 is attachable to a wall or other structure in appropriate fashion. A first opening 20 is located on the housing 12 while at least one second opening 22 is also located on the housing 12 below the first opening 20. A pair of mounting rods 24 are disposed within the housing 12 and are adapted to hold a paper towel roll R therebetween. The mounting rods 24 have sufficient resiliency to be sufficiently separated to allow mounting of the paper towel roll R, and each mounting rod 24 has a portion 26 that curves toward the other mounting rod 24 to hold the paper towel roll core and to allow the core to rotate thereabout. It is expressly recognized that other paper towel roll R mounting devices can be used within the scope and spirit of the present invention.

A paper dispersion system 28 is disposed within the housing 12 and dispenses a stream of paper P through the first opening. The paper dispersion system 28 is comprised of a mount bracket 30 onto which a pair of spaced apart brackets 32 are mounted. A cutter bar 34 having a serrated edge 36 is attached to the brackets 32. A drive roller 38 is rotatably disposed between the brackets 32 while a motor 40 is operatively connected to the drive roller 38 for rotating the drive roller 38. The drive roller 38 is either made from or has a layer of an appropriate tractionable material such as rubber, neoprene, or the like. A guide rod 42 is attached to each of the brackets 32. An idler roller 44 is rotatably disposed between the brackets 32 while a pair of leaf springs 46 are attached to the cutter bar 34 and bias against the idler roller 44. A guide plate 48 having an upper end 50, a lower end 52 and a curved medial portion 54 is attached to each bracket 32. A first sensor 56 is attached to the guide plate 48 proximate the lower end 52 while a second sensor 58 is attached to the guide plate 48 proximate the upper end 50.

A blower 60 is disposed within the housing 12 below the mount bracket 30; the mount bracket 30 acting as a fire wall between the blower 60 and the paper towel roll R. The blower 60 is of any appropriate design known in the art and may have a heating element 62 to heat the air that the blower 60 blows. The blower 60 blows air through the at least one second opening 22, although it is understood that the at least one second opening 22 can be replaced with a conventional nozzle of any appropriate design.

The device 10 is controlled via an appropriate controller 64.

In order to use the combination drying unit of the present invention, a paper towel roll R is mounted between the mount rods 24. A paper towel stream P is fed between the drive roller 38 and the idler roller 44 and out through the first opening 20. The guide rod 42 and the guide plate 48 help guide the paper towel stream P into position. A first switch 66, located within the housing 12, is operatively connected to the motor 40 and will, upon being depressed, activate the motor 40 to turn the drive roller 38 to assist in the feeding operation. The combination drying unit 10 is now ready for operation.

A user approaches the device 10 and uses a second switch 68 to activate the device 10. The second switch 68 is comprised of a sensor that detects the presence of an object, such as a user's hand or hands which are placed in the proximity of the sensor 68. This sensor 68 is of any appropriate design known in the art, however, a conventional push button switch can be substituted if desired. Appropriate labels 70 can be placed on the device 10 to assist in user understanding of the device 10. Once the device 10 is activated, the blower 60 will dispense a stream of air through the at least one second opening 22 for a first length of time. Upon expiration of this first length of time, the blower 60 is deactivated and the motor 40 is activated for a second length of time (the first length of time—for the air stream—and the second length of time—for the towel stream—may be the same or different). The motor 40 causes the drive roller 38 to rotate which causes the paper towel stream P to advance through the first opening 20. The tractionable surface of the drive roller 38 coupled with the idler roller 44 being biased against the drive roller 38 by the pair of leaf springs 46 assist in feeding the paper towel stream P through the first opening 20. After expiration of the second predetermined amount of time, the motor 40 deactivates. At this point, a paper towel sheet has been dispensed through the first opening 20 and the user removes the paper towel sheet by pulling the sheet along the serrated edge 36. It is recognized that the motor 40 may be activated during the time the blower 60 is also active instead of waiting for the blower 60 to deactivate.

If desired, the duration of the first length of time can be varied and the duration of the second length of time can also be varied. In order to vary the second length of time, a third switch 72 can be provided. The second length of time can be one of several durations. Initially, the second length of time is at its lowest (or highest) duration. Depression of the third switch 72 causes the second length of time to advance to the next highest (or next lowest) duration. The next depression of the third switch 72 causes the second length of time to go to the next highest (or next lowest) duration. This continues until the second length of time is at its highest (or lowest) duration, thereafter, a depression of the third switch 72 cycles the second length of time back to the initial time duration. This feature is useful in controlling the length of operation of the motor 40 which in turn controls the length of the paper towel sheet that is dispensed. This allows the operator of the device to vary the length of dispensed paper towel sheet based on customer needs. For example, the device 10 that is mounted in a ladies room will be set to dispense a longer sheet relative to a device 10 mounted in a gentlemens room to accommodate the different needs of the two sexes.

If upon activation of the second switch 68, the first sensor 56 senses the presence of a paper towel stream, the second switch 68 relays this information to the controller 64; thereafter, the device 10 performs in usual fashion. If upon the next activation of the second switch 68, the first sensor 56 again senses the presence of a paper towel stream, the second switch 68 relays this information to the controller 64, which deactivates the motor 40 during this cycle, although the blower 60 will operate in usual fashion. The controller 64 continues to deactivate the motor 40 until the first sensor 56 does not detect the presence of a paper towel stream P. Once the first sensor 56 does not detect the presence of a paper towel stream P, the device 10 goes back to normal operating mode. The necessity for such operation is that if the first sensor 56 detects a paper towel stream P through two consecutive cycles, either the dispensed paper sheet has not been removed and there is, therefore, no need to dispense further paper, or a jam has occurred within the device 10.

The second sensor 58 is used to detect the absence of a paper towel stream P. If the second sensor 58 fails to detect the presence of a paper towel stream P, this information is relayed to the controller 64. As this is probably the result of an out of paper condition, the controller 64 deactivates the motor 40 until the second sensor 58 detects a paper towel stream (paper has been replenished within the device 10). Additionally, the controller 64 increases the length of the first predetermined amount of time so that a user, who will not be given a paper sheet, has sufficient time under the blown air stream to accomplish the drying process during a single device cycle. Lastly, the controller 64 activates a light 74 to notify service personnel of the device's condition.

Figure 11:
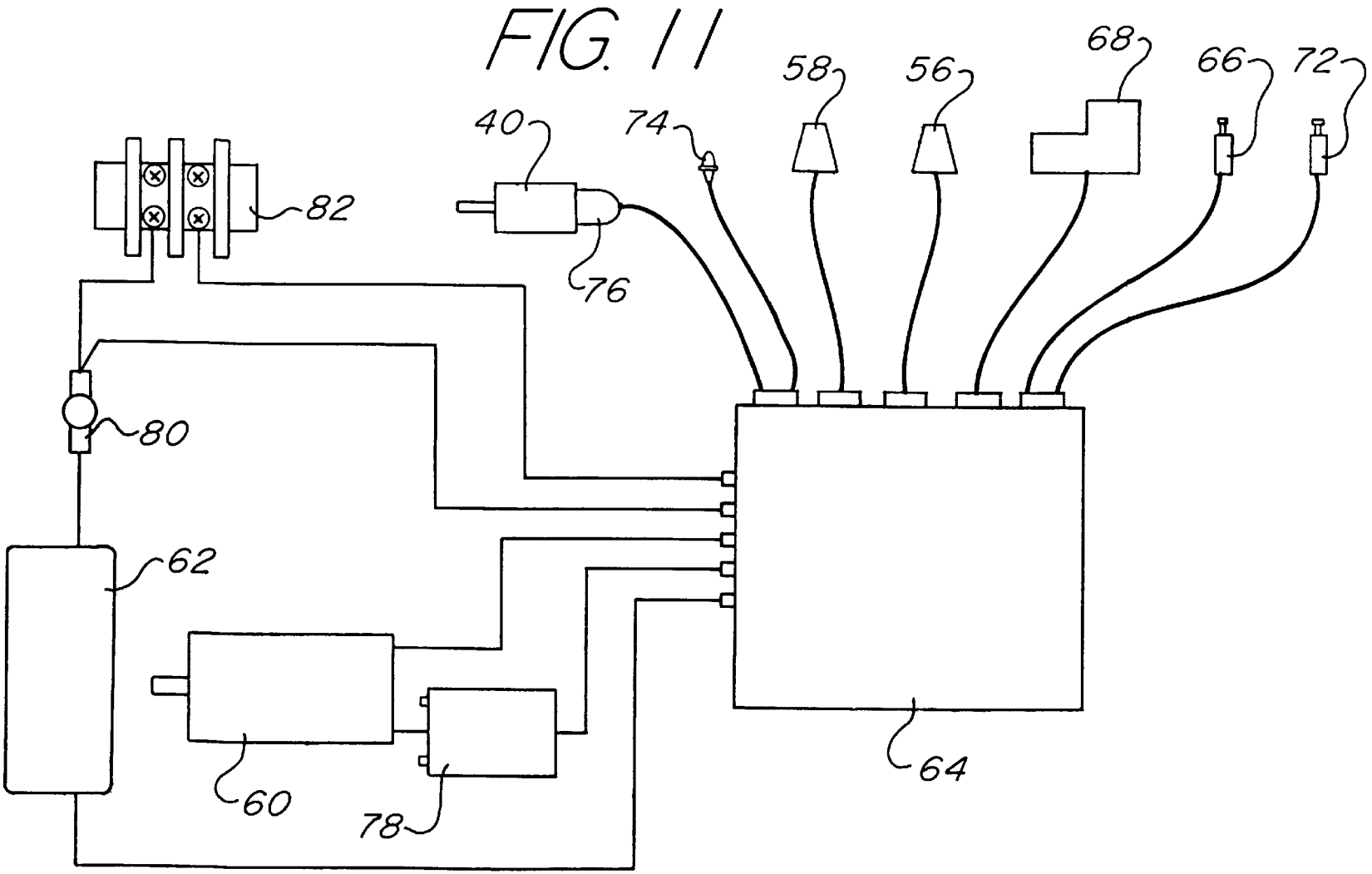
FIG. 11 is a schematic view of the control circuitry of the combination drying unit.

As seen in FIG. 11, the controller 64 is electrically connected to various parts of the combination drying unit 10, including the first sensor 56, the second sensor 58, the first switch 66, the second switch 68, the third switch 72, the light 74, the motor 40, the blower 60, and the heating element 62. As also seen in this figure, the motor 40 has a first fuse 76 associated with it, while the blower 60 has a second fuse 78 associated with it. The heating element 62 has a thermostat 80 to keep the heating element 62 at a desired temperature. The controller 64 is also connected to a terminal block 82 which is, in turn, connected to an appropriate source of electrical power by way of an appropriate electric cord 84.

While the invention has been particularly shown and described with reference to an embodiment thereof, it will be appreciated by those skilled in the art that various changes in form and detail may be made without departing from the spirit and scope of the invention.

I claim:

1. A combination drying unit for dispensing an air stream and dispensing a towel stream from a towel roll comprising:

a housing having a first opening and a second opening;

a pair of spaced apart rods for holding the towel roll;

a first roller rotatably disposed within the housing;

a motor operationally connected to the first roller for rotating the first roller;

a second roller rotatably disposed within the housing;

a blower, for dispensing the air stream through the first opening, disposed within the housing;

a first switch for activating the motor for a first length of time and activating the blower for a second length of time upon activation of the first switch.

2. The combination drying unit as in claim 1 further comprising a sensor, disposed within the housing, for detecting the towel stream and when the sensor detects the towel stream, the sensor deactivates the motor.

3. The combination drying unit as in claim 1 further comprising a sensor, disposed within the housing, for detecting the towel stream and when the sensor fails to detect the towel stream, the sensor deactivates the motor.

4. The combination drying unit as in claim 3 further comprising a light that is activated whenever the sensor fails to detect the presence of the towel stream.

5. The combination drying unit as in claim 3 wherein the blower is activated for an additional third length of time upon activation of the first switch whenever the sensor fails to detect the presence of the towel stream.

6. The combination drying unit as in claim 1 further comprising a second switch for activating the motor.

7. The combination drying unit as in claim 1 further comprising a second switch, operatively connected to the motor, such that upon depression of the second switch, the motor is activated an additional third length of time upon activation of the first switch.

8. The combination drying unit as in claim 7 wherein the third length of time is negative.

9. The combination drying unit as in claim 1 further comprising a serrated edge disposed within the housing proximate the second opening.

10. The combination drying unit as in claim 1 wherein the first switch comprises a sensor.

11. The combination drying unit as in claim 1 further comprising a heating element, located proximate the blower, for heating the air stream produced by the blower.

12. The combination drying unit as in claim 1 further comprising at least one spring disposed within the housing for biasing the second roller toward the first roller.

* * * * *